US008327785B2

(12) United States Patent
Nielsen

(10) Patent No.: US 8,327,785 B2
(45) Date of Patent: Dec. 11, 2012

(54) SHIP

(76) Inventor: Jens M. Nielsen, Dragør (DK)

( * ) Notice: Subject to any disclaimer, the term of this patent is extended or adjusted under 35 U.S.C. 154(b) by 0 days.

(21) Appl. No.: 12/736,058

(22) PCT Filed: Jul. 11, 2008

(86) PCT No.: PCT/DK2008/000393

§ 371 (c)(1),
(2), (4) Date: Oct. 28, 2010

(87) PCT Pub. No.: WO2009/109188

PCT Pub. Date: Sep. 11, 2009

(65) Prior Publication Data

US 2011/0041749 A1 Feb. 24, 2011

(30) Foreign Application Priority Data

Mar. 5, 2008 (DK) ..... 2008 00321
May 21, 2008 (WO) ..... PCT/DK2008/000187
Oct. 22, 2008 (WO) ..... PCT/DK2008/000370

(51) Int. Cl.
*B63B 25/02* (2006.01)

(52) U.S. Cl. ..... 114/72

(58) Field of Classification Search ..... 114/72
See application file for complete search history.

(56) References Cited

U.S. PATENT DOCUMENTS 2,218,688 A * 10/1940 Stewart ..... 114/78
3,162,168 A * 12/1964 Ferris et al. ..... 114/72
3,380,422 A * 4/1968 Bachko ..... 114/72
4,111,145 A 9/1978 Ohsaka
6,003,459 A * 12/1999 Nielsen ..... 114/72
6,105,525 A * 8/2000 Rapeli ..... 114/72

FOREIGN PATENT DOCUMENTS

DE 10081502 10/2002
EP 1035998 3/2002
GB 1203088 8/1970
GB 1556150 11/1979
JP 60131389 A * 7/1985

* cited by examiner

*Primary Examiner* — Edwin Swinehart
(74) *Attorney, Agent, or Firm* — Dykema Gossett PLLC

(57) ABSTRACT

A roll-on and roll-off ship comprising a front part, a rear part and a central part is disclosed. The ship is arranged with holds adapted to accommodate containers etc. in the front part and in the rear parts and roll on/roll off cargo in the central part of the ship. The central part extends from the tank top to a level above the weather deck. A ramp is provided in the aft part of the ship, and the roll on/roll off cargo transits from the ramp to the third cargo hold section via a passageway arranged in the aft part of the ship. The passageway may be arranged as a tunnel, which may be adapted to support cargo stowed above the passageway.

8 Claims, 4 Drawing Sheets

SHIP

BACKGROUND OF THE INVENTION

Field of the Invention

The present invention relates to a ship providing a high cargo capacity and flexibility through a unique arrangement of cargo hold sections for containers in combination with a cargo hold section accommodating vehicles.

The expression "weather deck" is throughout this specification intended to denote any deck exposed to the outside, i.e. a weather deck within the meaning of this specification forms an upwardly oriented closure of a ship's hull.

The expression "main deck" is throughout this specification intended to denote a deck extending between the forward and after ends of a ship. The main deck may constitute the highest water tight deck of the ship. The main deck may also be denoted "upper deck" or, in designs wherein the main deck is exposed to weather, the main deck may be denoted as "weather deck".

The expression "aft", "after" or "rear" is throughout this specification intended to denote a portion of a ship lying behind the middle portion of the ship.

The expression "fwd" or "forward" is throughout this specification intended to denote a portion of a ship lying in front of the middle portion of the ship.

Background

According to common shipbuilding practise, the rear part of cargo ships typically comprises a superstructure including a navigating bridge and means necessary for the propulsion of the ship including fuel tanks and the like, while the front part of the ship comprises the stem and often also store rooms and the like.

The central part of the ship comprises a hold which is constructed in accordance with the specific types of goods to be transported. The hold may thus be constructed specifically for the transport of one or more specific types of goods such as containers, vehicles incl. trailers or dry cargo etc. Particularly in the past, possibilities of utilizing cargo ships for carrying combinations of the above-mentioned types of goods were very limited.

To achieve increased flexibility of cargo ships, the so-called roll-on and roll-off ships, or RO-RO ships, have been developed over the past thirty years or so. Most of the ships are now based on the concept of providing a main deck or weather deck adapted for transport of containers and other lift-on and lift-off cargoes, while a plurality of tween decks are arranged below and/or above the main deck, and which may be used for transport of vehicles such as trailers, trucks or cars, etc., to be loaded using stern and/or side ramps. This concept is widely recognized and used; however, a common drawback of this concept is that the ship operates with unsuitable stability when the ship is loaded with gravity wise inhomogeneous cargo configurations, e.g., when only one type of cargo is transported.

As a result of the ship being inappropriately loaded, and in conditions where the resulting centre of gravity of the cargo is too high, the ship is forced to carry a substantial quantity of water ballast in order to outbalance the inappropriate centre of gravity of the cargo.

In loading conditions where the centre of gravity of the cargo is too low, the ship will operate with too much stability, resulting in a ship rolling very fast from side to side, leading to an inconvenient voyage for the crew and increased cargo damage, etc.

However, as far as the so-called RO-RO ships are concerned, prior art fails to suggest solutions wherein it is possible to achieve optimum flexibility and capacity. In particular, the conventional structure of the RO-RO ships have, due to the above stability-related drawbacks, set a limit to the quantity of additional types of goods that can be carried and to the conditions under which such goods may be carried.

European Patent No. 1035998 discloses a cargo ship wherein a refrigerated cargo hold section accommodating a relatively large number of tween decks with a small free height are arranged amidships with a second cargo in the form of containers arranged aft and forward the refrigerated cargo hold section. The refrigerated cargo hold section extends from the tank top of the ship to a height above the weather deck. The container holds, arranged aft and forward of the refrigerated cargo hold section, also extend from the tank top to a height above the weather deck.

The object of the above patent is to construct a refrigerator ship able to carry a high number of containers while minimizing or eliminating the need to carry water ballast.

DE 10081502 T discloses a general purpose cargo vessel configured for carrying RO-RO cargo as well as containers and/or break bulk. The vessel comprise a container hold section disposed at a specified distance from the ships midship and forward towards the bow such that the resulting centre of gravity of the containers lie forward the midship of the ship. Break bulk hold sections are disposed fwd. and aft of the ships midship in such a way that the resulting centre of gravity of the break bulk also lie forward of the midship of the ship. Vehicle hold sections, or RO-RO hold sections, are disposed in the aft part of the ship such that the resulting centre of gravity of the vehicles lie rear of the ships midship. According to the document, cargos having different weights may therefore be loaded simultaneously whereby the efficiency of the ship is increased. In loading conditions wherein only vehicles or RO-RO cargo are carried, the ships resulting centre of gravity obviously lie well aft of the ships midship whereby the ship will be trimming to the aft. The document suggest that this trimming to the aft may be outbalanced by loading water ballast in the forward part of the ship, e.g. in the forepeak tank. As intake and transport of water ballast, for environmental as well as for economical reasons, should be avoided, a ship designed in accordance with DE 10081502 T may therefore today be considered insufficient.

U.S. Pat. No. 4,111,145 discloses a cargo ship which can be used in either or both of a roll-on and roll-off and a lift-on and lift-off mode, provided with a cargo hold which is covered with an inner bottom plating, a second deck, an auxiliary deck, an exposed deck, and having a plurality of transverse frame structures within the hold. The frame structures are suitably spaced apart from each other and have openings adapted to be opened or shut according to the use in roll-on and roll-off or lift-on or lift-off mode, such that the frame structures when opened is not interfering with free movement of roll-on and roll-off traffic around the decks. The overall appearance of the disclosed ship may generally be considered as a typical RO-LO ship with large hatches for handling and stowage of containers into the full length of the RO-RO cargo hold.

BRIEF DESCRIPTION OF THE INVENTION

One object of the present invention, according to the preamble of this specification is to:

provide an improved ship with no stability nuisances, and wherein the ship is able to carry different combinations of cargo, at least one type of which is vehicles or cargo to be stowed by means of wheeled vehicles, while allowing greater amounts of the other goods, such as containers to be transported at the same time, while at the same time allow vehicles or cargo to be stowed by means of wheeled vehicles to enter a space for holding the vehicles or cargo to be stowed by means of wheeled vehicles without causing substantial loss of stowage space for other goods, such as containers.

According to the present invention, the above objects are met by providing a ship according to the introductory part of this specification wherein:

The rear part of the ship comprises the second cargo hold section for accommodating a cargo in the form of containers. The second cargo hold section is defined inter alia by the hull and the weather deck where the weather deck is provided at a height above the baseline of the ship and comprising access hatches or openings providing access to the second cargo hold section, The central part of the ship comprises the third cargo hold section wherein the third cargo hold section is arranged substantially symmetrically amidships of the ship, The navigating bridge of the ship is arranged in the central part of the ship, above the third cargo hold section, The crew accommodation quarters is arranged in the central part of the ship, above the third cargo hold section.

A ship configured according to the above allows different combinations of cargos to be transported without stability nuisances. In particular, it is rendered possible to transport one kind of cargo only without the ship being forced to operate under unfavourable stability/loading conditions whereby:

the ship may operate without the cargo constituting vehicles or cargo to be stowed by means of wheeled vehicles without the resulting stability being too low.

the ship may operate without the cargo constituting containers without the resulting stability being too high.

This allows the ship owner or operator of the ship to obtain favourable Stability-wise loading conditions and provides a high degree of flexibility.

Favourable loading conditions on one hand eliminates the need to transport water ballast, while on the other hand provides a comfortable voyage for the crew, as the ship will not be forced to operate under loading conditions wherein the resulting centre of gravity is too high.

A ship designed according to the introductory part above enables the ship owner or operator to obtain greater earnings per voyage as a greater part of the ships deadweight is freed, entailing increased payload.

The deadweight is the total weight that a ship is allowed to carry, including cargo (payload as well as water ballast), fuel, stores and crew.

Conclusively, a ship constructed according to the introductory part of this specification will be able to operate without vehicles or cargo to be stowed by means of wheeled vehicles, as the rest of the goods, e.g. containers, may be stowed relatively low against the keel or tank top forward and aft of the third cargo hold section. A favourable "metacentre height", which is a skilled persons unambiguous and well defined measurement equivalent to a ships "stability arm" determined on basis of the ship's hull form and the entire ship's vertical centre of gravity, may hereby be maintained.

Since, in conventional RO-RO ships, the second cargo in form of containers generally is carried on or above the weather deck, the metacentre in these ships is very unfavourable when sailing without cargo below the weather deck. In such loading conditions, it will typically be necessary to carry a substantial quantity of water ballast in order to lower the ships centre of gravity.

Prior art holds examples of RO-RO ships being able to accommodate containers below the weather deck, however this is only possible upon removal of hatches and the like, and as the containers are stowed in the "garage space" below the weather deck, these ships do not offer a high degree of flexibility for the ship owner or operator.

According to one embodiment, the passageway extending from the shore ramp, or space suitable for receiving an external shore ramp, to the third cargo hold section is arranged as an open or closed tunnel and wherein the roof of the passageway is adapted to directly or indirectly support cargo in the form of containers.

According to another embodiment, the uppermost deck of the third cargo hold section extend at least 1.5 meters above the weather deck provided in front part and/or the rear part of the ship.

According to another embodiment, the length of the third cargo hold section is at least 15% of the length of the ship.

According to another embodiment, the navigating bridge of the ship is arranged in the central part of the ship, above the third cargo hold section.

When the navigating bridge is arranged substantially amidships, it is possible to arrange relatively high stacks of containers in front of the navigating bridge, as the current maritime rules on the mate's visibility line of sight to the horizon are still observed.

According to another embodiment, the crew accommodation quarters is arranged in the central part of the ship, above the third cargo hold section.

Arranging the crew accommodation in the central part of the ship, above the uppermost deck accommodating vehicles or cargo to be stowed by means of wheeled vehicles, significantly increases the crew's comfort, as this arrangement to a high degree isolates the accommodation from the noise and vibrations stemming from the machinery arranged in the aft part of the ship.

According to another embodiment, the upper deck of the central part of the ship is adapted to support a cargo, such as containers, arranged above the uppermost deck accommodating vehicles or cargo to be stowed by means of wheeled vehicles.

According to another embodiment, the third cargo hold section comprise tween decks some of which being hoist able between at least a lowered position and a stowed position which allows for the accommodation or stowage of vehicles or cargo with varying heights. The free height required for e.g. trailers may be as much as abt. 7 meters or more, while the free height required for private cars may be as low as 1.7 meters.

According to another embodiment, the first and second cargo hold sections are provided with cell guides adapted to facilitate stowage of containers, such as 20, 40 or 45 foot containers.

According to another embodiment, the third cargo hold section is ventilated by means of ducting arranged in the forward and/or aft end of the central part of the ship.

According to another embodiment, access hatches, provided in the first and second cargo hold sections, is adapted to support a cargo, such as containers.

According to another embodiment, the passageway is provided in one and/or both sides of the rear part of the ship, whereby loading and unloading of vehicles are facilitated.

According to another embodiment, the passageway is at least partially inclined such that vehicles enters the central part of the ship at a height above the baseline of the ship being different from a height above the baseline of an area accommodating the shore ramp, or space suitable for receiving an external shore ramp (ramp arranged on the quay).

According to another embodiment, the walls or bulkheads, which extend in a transverse direction of the ship, are arranged with one or more steps such that the uppermost deck is shorter, in a longitudinal direction of the ship, than the lowermost deck.

According to another embodiment, the passageway extending from the shore ramp, or space suitable for receiving an external shore ramp, to the third cargo hold section is able to assume different widths by means of handling a first movable deck portion of the passageway and a second movable portion of a side defining an upper portion of the ships engine room.

According to another embodiment, the central part of the ship is arranged with at least one deck accommodating vehicles or cargo to be stowed by means of wheeled vehicles, at a height above the ship's main deck and/or weather deck.

According to another embodiment, the ship is provided with the walls or bulkheads extending in the transverse direction of the ship, and where the walls or bulkheads directly or indirectly adjoin the first and third, and second and third cargo hold sections.

According to another embodiment, the longitudinal walls of the third cargo hold section are, to a great extent, disposed solely within the area of the hull where the sheathing is substantially plane, which simplifies the construction of means for ventilation and ramps etc.

According to one embodiment, the third cargo hold section is arranged substantially symmetrically amidships of the ship in order to obtain relatively symmetrical loading conditions and to ensure favourable stability as regards to the trim moment of the ship, however this is not in any way limiting for the present invention.

It may be preferred that access for the vehicles or cargo to be stowed by means of wheeled vehicles into the third cargo hold section is facilitated by at least one shore ramp preferably being arranged in the aft part of the ship, although it may prove beneficial also, or as an alternative, to arrange a ramp in the side of the ship, whereby vehicles are allowed to enter the third cargo hold section without travelling through the rear part of the ship.

Alternatively, the ship may, instead of the abovementioned ramp, be provided with space for accommodating or receiving a ramp being arranged ashore. (I.e. an external shore ramp)

The vehicles or cargo to be stowed by means of wheeled vehicles may, if the ramp is arranged in the aft part of the ship, move or drive in one or more dedicated driveways connecting an aft shore ramp with the third cargo hold section. The structure of the at least one driveway may be adapted to support cargo arranged directly or indirectly above the driveway. Further, the at least one driveway may be arranged on, above or below the weather deck or main deck of the ship, and in port side and/or in starboard side of the ship. Further, the driveway may be in the form of an open structure or a closed structure forming a tunnel or the like. This allows a ship according to the present invention to birth at already present harbour facilities, as the internal arrangement does not require restructuring of the present harbour facilities.

The ship's propulsion plant, or engine room, may accommodate various types of main engines. Typically, a RO-RO ship is propelled either by a set of medium speed four stroke engines driving two propellers through two gearboxes and two shafts, or by a single engine, such as a slow speed engine, driving one propeller through one shaft.

In configurations wherein the ship is propelled by means of two four stroke engines, the engines are typically located in the port side and starboard side of the engine room, while if the ship is propelled by means of only one slow speed main engine, the engine incl. propeller and propeller shaft is arranged in the centreline of the ship.

As a slow speed two-stroke main engine typically is higher than the aforesaid medium speed four stroke engines, an engine room accommodating a two stroke engine also has to, at least in the area directly above the main engine, be higher than the engine room accommodating aforesaid medium speed engines. As a consequence, an engine room accommodating a slow speed engine may extend through or above one or more decks incl. the main deck.

At the majority of RO-RO ships, the roll-on and roll-off cargo enters the ship at the main deck by means of a ramp arranged at the stern of the ship. In designs wherein the ship is propelled by means of a single slow speed two stroke main engine, and the engine room extends above the main deck, the passage way into a forward part of the ship is limited by the section of the engine room extending immediately above the main engine. In the ship according to the present invention, a substantial part of the RO-RO cargo has to roll past the aforesaid section either on one or both sides of the engine.

The extending section of the engine room may be considered an obstacle to the traffic which, often at considerable speed, needs to either enter or exit the ship. Many operators allow simultaneously loading and unloading of the RO-RO cargo leading to a degree of congestion in the area of the stern ramp incl. the aft. part of the main deck, immediately within the ship. Typically, the main engine is arranged in the area of the aft part of the main deck, leaving wide protrusions and/or extensions an unfavourable obstacle for the traffic.

Another object of the present invention is to teach a solution wherein the passageway, in the area immediately next to and above the main engine, is widened allowing for easy and safe passage of the roll-on roll-off cargo.

The vehicles or cargo to be stowed by means of wheeled vehicles may have access to the various decks and/or tween decks by means of internally arranged ramps and/or lifts.

DETAILED DESCRIPTION OF THE INVENTION WITH REFERENCE TO THE FIGURES

The invention will be explained below in detail and with reference to preferred embodiments as shown in the figures.

Figure 1:
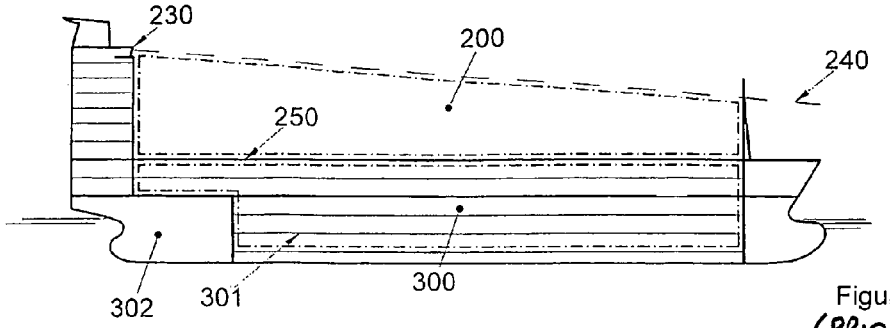
Figure 1 (PRIOR ART)
FIG. 1 schematically illustrates a side view of a ship according to the prior art.

FIG. 1 shows an example of a RO-RO ship according to the prior art. The ship is seen in partial vertical longitudinal section. Numerals 200 and 300 respectively refers to first and second cargo hold sections, wherein 200 refers to a cargo hold section accommodating cargo to be lifted on or off the ship, such as containers, and 300 refers to a cargo hold section accommodating vehicles to be rolled on or off the ship. The cargo hold section 300 comprises a number of tween decks 301, arranged below the weather deck, and extending substantially throughout the length of the ship excluding the engine room 302.

Figure 2:
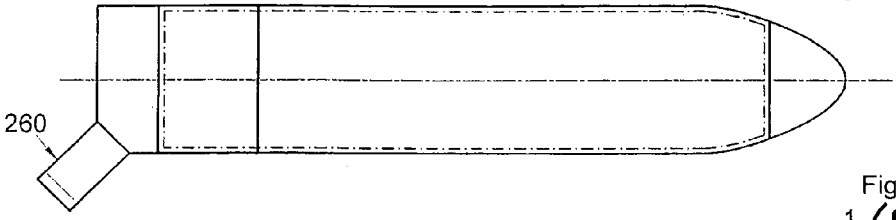
Figure 2 (PRIOR ART)
FIG. 2 schematically illustrates a top view of a ship according to the prior art.

The weather deck 250, which forms the closure of the hull upwardly, also serves to support a surface cargo, which is indicated in dotted line in the drawing, and which will normally consist of containers stacked on top of each other and lashed to the weather deck 250. The stacking height of the containers will usually be limited partly with a view to the stability of the ship against heeling and partly by international maritime rules, according to which a line of sight 240 from the navigating bridge 230 must reach the surface of the sea at a certain distance from the stem. The cargo hold section 300, which may constitute private cars or trailers incl. containers on trailers, etc., boards the ship, e.g., via the ramp indicated by pos. 260 in FIG. 2.

It is clear that the stability of the ship will be affected considerably if the cargo hold section 300 is empty and the cargo hold section 200 is loaded, e.g., with containers.

Cargo ships often sail one way with one type of cargo only, and return with a second cargo only. To compensate for such load situations or loading conditions, ballast tanks, into which seawater is pumped, will normally be incorporated, and in some cases occupying up to 30% of the loading capacity, or deadweight, of the ship. Further, these tanks also take up space within the ship which advantageously could be used for accommodating cargo.

From the above, it is clear that on a voyage wherein the ship carries containers only, it is only possible to carry a relatively small number of containers, which must be stacked very low on the weather deck 250.

Seen from an economic point of view, this situation is undesirable of course, as it reduces the earnings of the ship owner unnecessarily.

Figure 3:
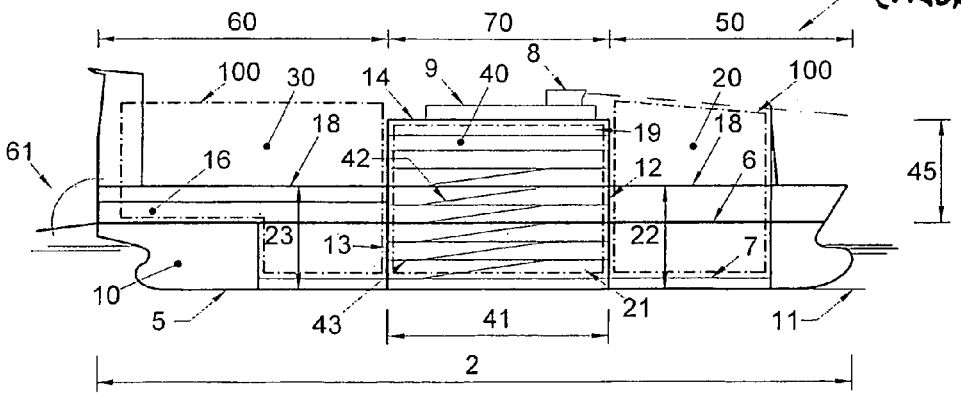
FIG. 3 schematically illustrates a side view of an embodiment of a ship according to the present invention.

FIG. 3 shows an embodiment of a ship according to one aspect of the present invention, seen in partial vertical longitudinal section. The illustrated ship 1, like the conventional ship, e.g., according to FIGS. 1 and 2, comprises hulls having a length 2, a main deck 6, a weather deck 18 and cargo hold sections 20, 30, 40.

Figure 4:
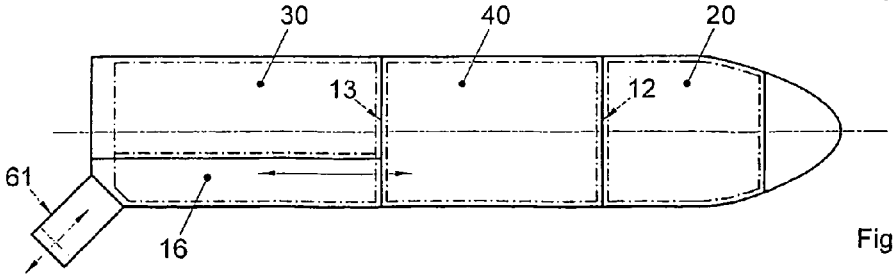
FIG. 4 schematically illustrates a top view of an embodiment of a ship according to the present invention.

The ship's cargo hold constitutes three cargo hold sections:

- a first cargo hold section 20 arranged in the forward part 50 of the ship 1,
- a second cargo hold section 30 arranged in the aft part 60 of the ship, and
- a third cargo hold section 40, arranged in the central part 70 of the ship and accommodating the roll-on and roll-off cargo. The third cargo hold section is, as can be seen in FIGS. 3 and 4, arranged substantially in the longitudinal centre of the ship. The third cargo hold section 40 may at least partially extend backwards into the second cargo hold section 30.

As can be seen in FIG. 3, the third cargo hold section 40 extends above and below the weather deck 18.

The rear part 60 of the ship 1 comprises a space 10 for machinery inc!. machinery for propulsion, etc., and the second cargo hold section 30.

The front part 50 of the ship 1 comprises the stem of the ship 1 and the first cargo hold section 20. Both the first and second cargo hold sections 20, 30 extend upwardly, possibly up to or above the uppermost deck 19 accommodating vehicles, either from the ship's tank top 7, directly or indirectly, or from a deck above the tank top 7, e.g., the main deck 6, or any deck space provided by any other deck and being suitable to support a cargo.

The weather deck 18 and/or the main deck 6 may accommodate access hatches giving access to the holds for vertical lowering of goods, in particular containers. To permit lowering of the containers, the hatches are preferably provided in the entire width of the cargo hold sections like in conventional container ships, and possible hatch covers may be constructed to support a surface cargo.

The ship 1 may equally be constructed with open top cargo hold sections, i.e. that the cargo hold sections 20, 30 are arranged without hatch covers, much like "open top" container ships.

The hold sections 20, 30 may be provided with cell guides for containers with or without stoppers reducing the stack weight for the lowermost containers.

Moreover, the main deck 6, as well as the weather deck 18, in the front part 50 and the rear part 60 of the ship 1 may be arranged at different levels above the base line 11 of the ship 1.

As per the above, the ship 1 further comprises a central part 70 having a third cargo hold section 40 also indicated by dotted lines, and the longitudinal extent of the third cargo hold section 40 (in the fore and/or aft direction of the ship) preferably constitutes at least 15% of the overall length 2 of the ship 1.

The width of the third cargo hold section 40 may preferably correspond substantially to the width of the ship 1; however, it will be possible to interpose means for ventilation, sprinkling, side tanks or voids, etc., between the sides of the ship 1 and the third cargo hold section 40.

The third cargo hold section 40 is intended to transport vehicles or cargo to be stowed by means of wheeled vehicles.

The third cargo hold section 40 comprises a number of fixed decks and preferably a number of hoist able or lower able decks 43, one or more in between the fixed decks, allowing for varying free heights in some of the decks whereby roll-on roll-off cargo with varying height may be accommodated. The free heights between the decks may be anywhere in between abt. 1.7 meters to more than 7 meters. It will of course also be possible to arrange the third cargo hold section 40 with fixed decks only.

As can be seen in FIG. 3, the uppermost deck of the third cargo hold section 40 is indicated by pos. no. 19, and the lowermost deck of the third cargo hold section 40 is indicated by pos. no. 21. The decks 19 and 21 are according to a preferred embodiment arranged such that the lowermost deck 21 is arranged below the weather deck 18, and the uppermost deck 19 is arranged above the weather deck 18.

In certain embodiments, and according to requirements of rules and regulations relating to the intact and damage stability of the ship, it may be necessary to arrange watertight transverse and/or longitudinal bulkheads dividing one or more of the decks of the third cargo hold section 40. Such bulkheads may also be provided in the first and second cargo hold sections 20, 30.

The third cargo hold section 40 may be delimited directly or indirectly in a longitudinal direction by means of transverse walls or bulkheads 12, 13 and in a vertical direction by the tank top 7 and the roof/top or ceiling deck 14 of an uppermost deck within the third cargo hold section 40.

Further, the third cargo hold section 40 may be arranged with deck strengths, means for lighting, fire fighting and ventilation etc. corresponding to the customary shipbuilding practice of cargo ships incl. roll-on and roll-offs ships.

The deck illustrated by pos. no. 14 in FIG. 3 is preferably adapted to support a deck superstructure 9 including a navigating bridge 8 of the ship 1 and optionally a surface cargo in the form of containers.

Access for the roll-on and roll-off cargo to the third cargo hold section 40 is arranged via at least one passageway 16, which may be partially or fully enclosed, e.g. arranged as a tunnel or the like. The passageway 16 extends from a shore ramp 61 in the rear part 60 of the ship 1 to the third cargo hold section 40. The passageway 16 may be arranged with several lanes for allowing simultaneous loading and unloading of the roll-on and roll-off cargo. Further, the uppermost enclosure, or the roof, of the passageway may advantageously be adapted to support cargo. The passageway may be arranged below, on or above the main deck 6 as well as the weather deck 18.

Access for the roll-on and roll-off cargo to the different decks in the third cargo hold section 40 is arranged via a plurality of ramps 42 which may be movable between the decks or form part of a fixed structure. In certain decks, it may be necessary to arrange watertight doors in order to fulfil requirements relating to damage stability etc. The access or connection between the decks may also be provided by internal lifts (not shown).

The ship 1 may, as per the above, in its aft part 60, be provided with at least one shore ramp 61. The at least one shore ramp 61 may be arranged as a quarter ramp, extending aft either to the ships port or starboard side, wherein the centreline of a part the ramp 61 may form an angle between the centre line of the ship. Further, the ramp may also be parallel with the centreline of the ship. The ship 1 may also be provided with one or more side ramps (not shown), which preferably are arranged in one or both sides of the ship and preferably in the region of the third cargo hold section 40, allowing for an alternative passageway for the roll-on roll-off cargo.

In the embodiment according to FIG. 3, the uppermost tween deck 19 of the third cargo hold section 40 is arranged at a height above the weather deck 18 of at least 1.5 meters.

As an alternative, the roof/top or ceiling deck 14 of the uppermost deck 19 within the third cargo hold section 40, may be arranged at a height above the baseline 11 of the ship equal at least 65% of the moulded breadth of the hull of the ship 1, however preferably about 90% or more.

The third cargo hold section 40 may accommodate means for ventilating the cargo hold section. The ventilating means (not shown) may take any form however a preferred embodiment comprises ducting means arranged in the forward and/or aft end of the central part 70 of the ship 1.

When comparing the ship according to the present invention with a conventional RO-RO ship according to FIG. 1, it will be clear that selection of a suitable height of the third cargo hold section 40 will provide the same volume for accommodating RO-RO cargo.

FIG. 4 is a top view according to FIG. 3.

Figure 5:
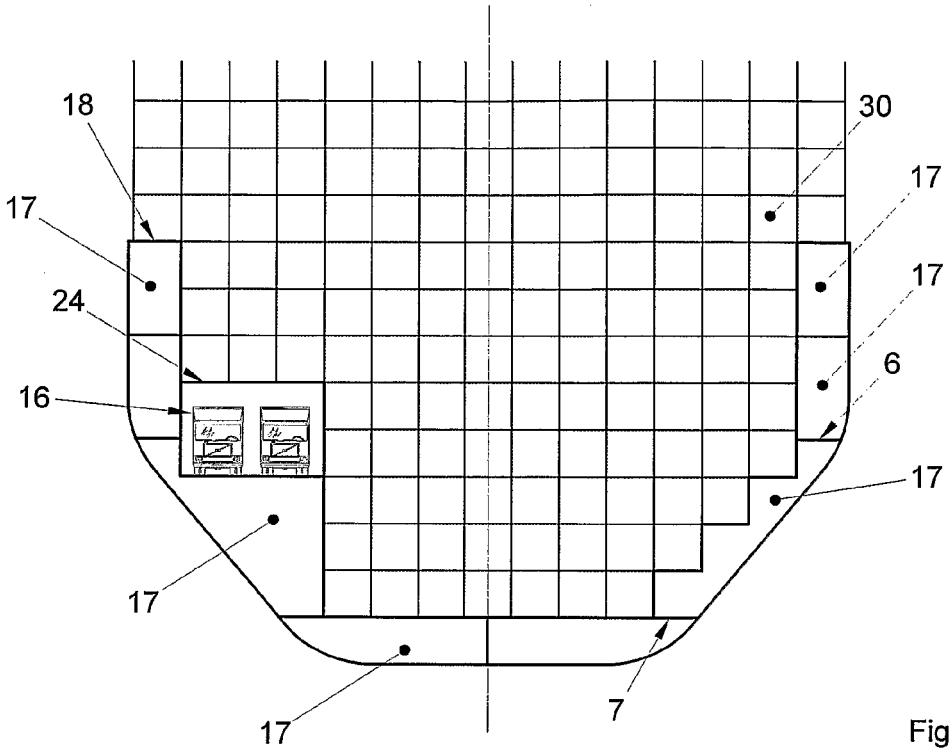
FIG. 5 schematically illustrates a cross section through an aft. part of a ship according to the present invention.

FIG. 5 is a principal transverse cross-sectional view in the second cargo hold section 30 just aft of the third cargo hold section 40. The figure illustrates the passageway 16 for roll-on and roll-off cargo, here depicted as trucks. Pos. no. 17 illustrates spaces normally used for oil tanks, water tanks, ventilation and passageways or only as a part of the ships steel structure. Pos. no. 30 illustrates containers stowed on the tank top 7 of the ship and upward. The containers may, as depicted in the figure, equally be stowed directly or indirectly on or above the passageway 16.

Figure 6:
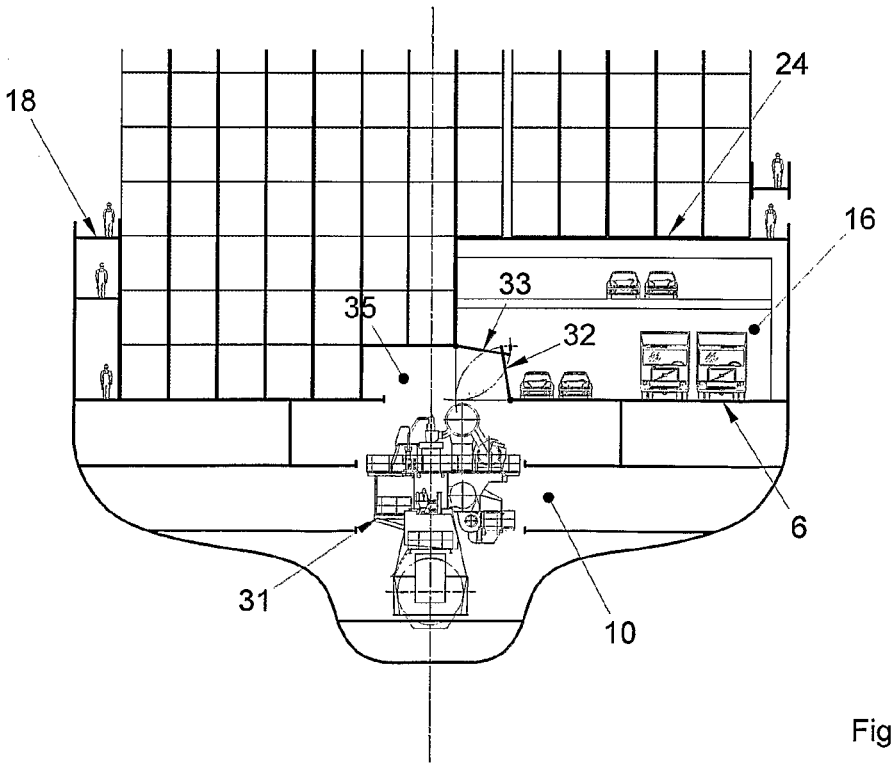
FIG. 6 schematically illustrates a cross section through an aft part of a ship according to the present invention.

FIG. 6 is another principal, transverse cross-sectional view partially similar to FIG. 5, however; the figure illustrates a section through the engine room 10, and further, the section represents another embodiment of the ship according to the present invention. As can be seen in the figure, the ship is propelled by means of a slow speed two-stroke main engine 31 arranged in the centreline of the ship. The height of the engine 31 extend above the main deck 6 necessitating that the engine room 10, in the area above the main engine 31 extends above the main deck. The local protrusion 35 of the engine room through the main deck 6 into the passageway 16 entail a local restriction to the passageway 16, which connects the third cargo hold section 40 with the stern ramp 61. The local protrusion 35 provides space for the upper part of the main engine 31. The space also accommodates various hoisting means, etc., needed for service, maintenance and repair of the main engine. As shown in the figure, a part of the deck 32 and a part of the sides 33 defining the upper portion of the engine room 10 may be hinged in such a way that the local protrusion 35 incl. the passageway 16 may assume different configurations:

- a first and operating configuration wherein the part of the deck 32 is supported horizontally, and the part of the sides 33 defining the upper portion of the engine room 10 is arranged substantially vertical, and
- a second servicing configuration wherein the part of the deck 32 is supported vertically, while the part of the sides 33 defining the upper portion of the engine room 10 is arranged substantially horizontal.

The first configuration is particularly advantageous under loading and unloading of roll-on and roll-off cargo, as the passageway 16 is widened significantly allowing for two-way traffic at higher speeds.

The second configuration renders it possible to fulfil engine manufacturer's requirements relating to ample space around the main engine 31.

The part of the sides 33 may further comprise lifting means (not shown) required for maintenance of the main engine 31.

Figure 7:
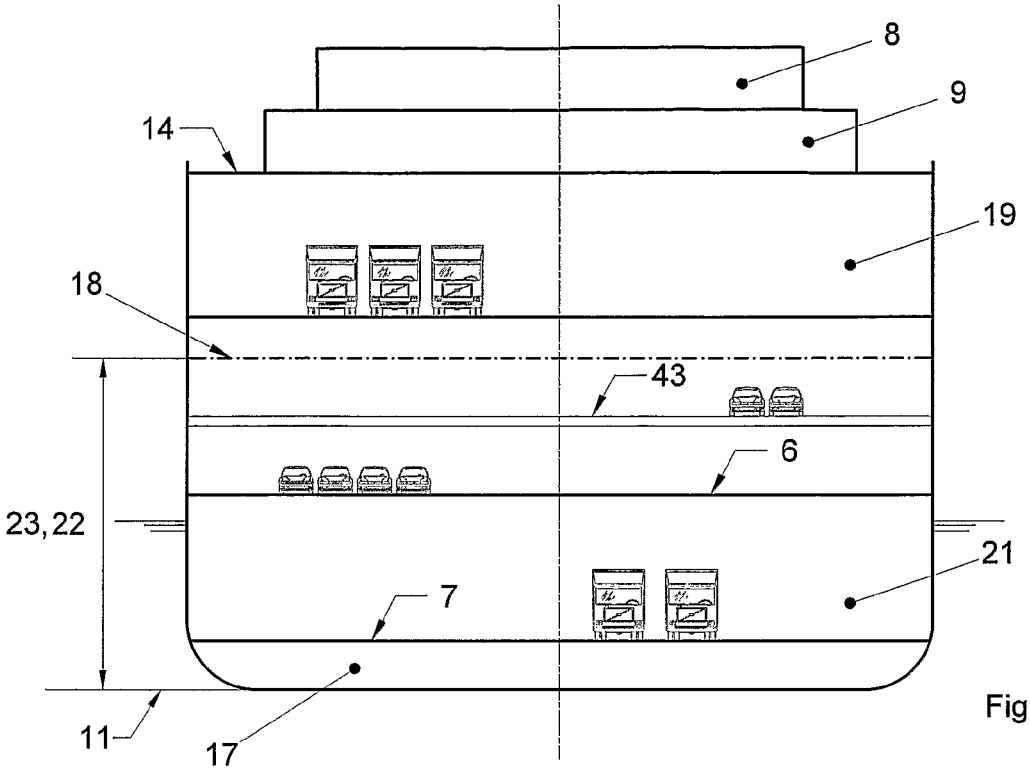
FIG. 7 schematically illustrates a cross section through a central part of a ship according to the present invention.

FIG. 7 shows a principal cross section in through the third cargo hold section 40 arranged in the central part 70 of the ship 1. Pos. no. 18 illustrates the weather deck provided forward and/or aft of the central part 70 of the ship 1.

The weather deck 18 may be arranged in varying heights above the ships baseline 1, however for illustrative purposes, the weather deck 18 is on the figure illustrated as being arranged in one height only. The heights are illustrated by pos. no 22 and. 23.

As shown in FIG. 7, the uppermost deck 19, is arranged at a level above the weather deck 18 while the lowermost deck 21 is arranged at a level below the weather deck 18.

According to some embodiments, the ship 1 may be provided with a central part 70 comprising an uppermost deck 19 arranged only partially above the weather deck 18.

The figure further illustrates crew accommodation quarters 9 provided above the uppermost deck 19, as well as a navigating bridge 8 provided above the crew accommodation quarters 9.

The third cargo hold section 40 may encompass two or more decks for accommodating vehicles. The embodiment illustrated under FIG. 7 comprise four deck spaces for accommodating vehicles, whereof one deck is arranged as a tween deck 43 being hoist able between at least a lowered position and a stowed position.

Pos. no 7 illustrates the tank top plating and pos. no. 17 illustrates spaces normally used for oil tanks, water tanks, structures, piping and the like.

Two or more of the decks, e.g. as shown in FIG. 7, may be connected by not shown ramps or internal lifts, however according to a preferred embodiment; all the decks within the third cargo hold section 40 are accessible at least by means of one or more internal ramp and/or lifts.

Figure 8:
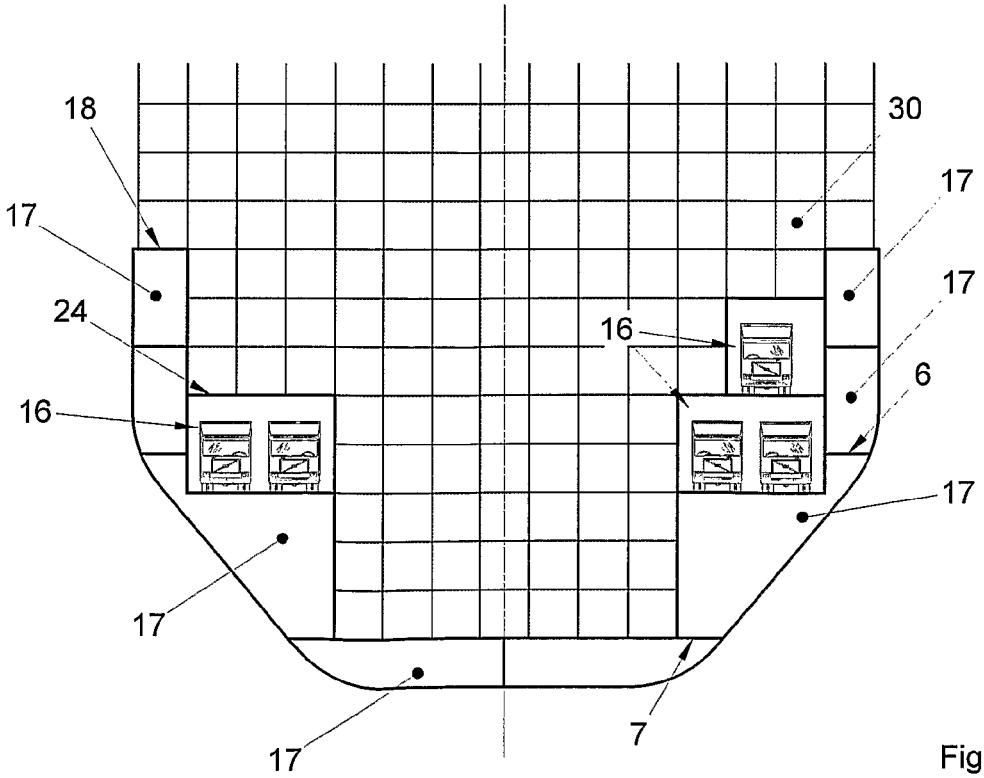
FIG. 8 schematically illustrates a cross section through an aft. part of a ship according to the present invention.

FIG. 8 is a principal transverse cross-sectional view in the second cargo hold section 30 just aft of the third cargo hold section 40. The figure, much like FIG. 5, illustrates two passageways 16 for roll-on and roll-off cargo, here depicted as trucks. It can be seen that one and/or both of the passageways 16 may be configured in two levels, such that the required time for loading and unloading of vehicles is minimized. Pos. no. 17 illustrates spaces normally used for oil tanks, water tanks, ventilation and passageways or only as a part of the ships steel structure. Pos. no. 30 illustrates containers stowed on the tank top 7 of the ship and upward. The containers may, as depicted in the figure, equally be stowed directly or indirectly on or above the passageway 16.

Although not shown, the passageway 16 may of course also be arranged substantially in the centreline of the ship.

Figure 9:
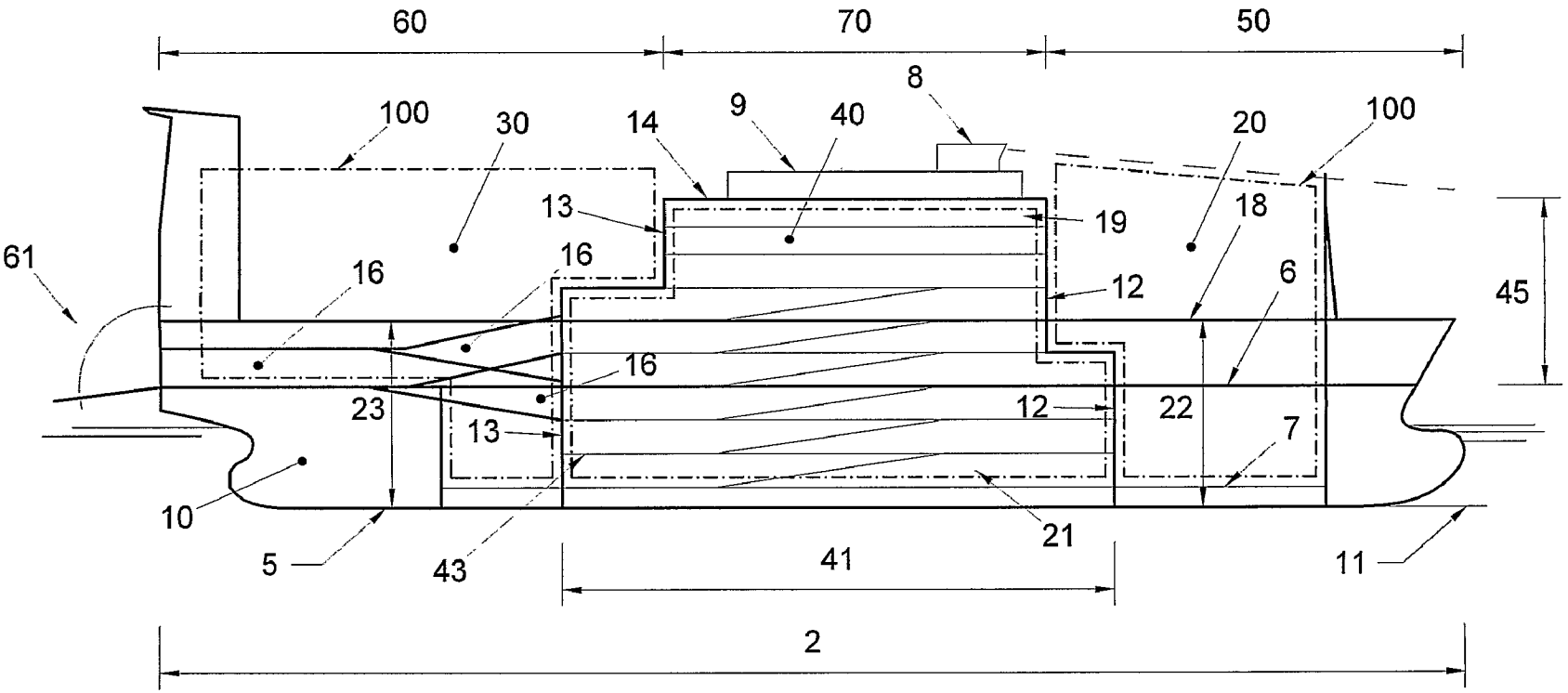
FIG. 9 schematically illustrates a side view of an embodiment of a ship according to the present invention.

FIG. 9 schematically illustrates a side view of an embodiment of a ship according to the present invention wherein the walls or bulkheads 12, 13, which extends in a substantially transverse direction of ship 1, are arranged with longitudinal steps such that the uppermost deck 19 of the third cargo hold section 40 is shorter, in a longitudinal direction of the ship 1, than the lowermost deck 21 of the third cargo hold section 40.

As can be seen in FIG. 9, the third cargo hold section 40 in the illustrated embodiment extends, as indicated by numeral 41, forward and aft below a part of the first and second cargo hold sections 20, 30, whereby space is provided for stowage of cargo such as containers above underlying portions of the third cargo hold section 40 apart from the deck 14 of the uppermost deck within the third cargo hold section 40

FIG. 9 further illustrates the passageway 16 arranged such that vehicles are allowed to enter different decks 43 provided in the third cargo hold section 40. Although not illustrated in FIG. 9, the passageway 16 may be provided with tween decks in order to facilitate either stowage or loading and unloading of vehicles.

To illustrate some advantages of the present invention, a comparison between a ship according to the prior art as per FIG. 1 and a ship according to the present invention, and as shown in FIG. 3, both of which having a length of about 300 meter, will be as follows:

A ship according to the prior art and according to FIG. 1, when fully loaded with containers only and no roll-on and roll-off cargo will for stability reasons only be able to carry about 2,000 20-foot containers, without having to load water ballast.

A ship according to the present invention and according to FIG. 3 will be able to carry about 3,000 containers without being forced to load water ballast, this allows for about 1,000 containers more as payload.

In order for the ship according to FIG. 1 to be able to carry 3,000 containers, the ship is forced to carry a significant quantity of water ballast, possibly as much as 8,000-10,000 ton.

The building costs for both ship types are substantially the same, about US$ 100 million per ship in the year 2008. Also the operational cost for both ships is substantially the same, wherein both ships are able to carry same quantity of roll-on and roll-off cargo.

The invention claimed is:

1. A ship comprising a hull, a navigating bridge, a crew accommodation quarters, a weather deck, a front part, a rear part, a central part, and first, second and third cargo hold sections, wherein:

said front part of said ship comprises said first cargo hold section for accommodating a cargo in the form of containers, said first cargo hold section being defined, inter alia, by said hull and said weather deck, said weather deck being located at a first height above a baseline of said ship and comprising access hatches or openings providing access to said first cargo hold section, said rear part of said ship comprises (a) a shore ramp, or a space suitable for receiving an external shore ramp, allowing vehicles to board said ship, (b) said second cargo hold section for accommodating a cargo in the form of containers, said second cargo hold section being defined, inter alia, by said hull and said weather deck, said weather deck being provided at a second height above said baseline of said ship and comprising access hatches or openings providing access to said second cargo hold section, and (c) a passageway extending from said shore ramp, or a space suitable for receiving an external shore ramp, to said third cargo hold section, said central part of said ship comprises said third cargo hold section, inter alia, being defined by an uppermost deck for accommodating vehicles, a lowermost deck for accommodating vehicles, and walls or bulkheads extending in a transverse direction of said ship, said uppermost deck being located at least 1.5 meters above said weather deck provided in said rear part of said ship, said lowermost deck is arranged below said first and second heights of said weather deck, and said walls or bulkheads have one or more steps such that said uppermost deck is shorter in a longitudinal direction of said ship than said lowermost deck, said third cargo hold section comprises one or more tween decks for accommodating vehicles, said tween decks are at least partially interconnected by ramps, and said third cargo hold section being arranged substantially symmetrically amidships of said ship, wherein said navigating bridge of said ship is arranged in said central part of said ship, above said third cargo hold section, and wherein said crew accommodation quarters is arranged in said central part of said ship, above said third cargo hold section.

2. The ship according to claim 1, wherein said passageway is an open or closed tunnel having a roof for directly or indirectly supporting cargo container.

3. The ship according to claim 1, wherein a length of said third cargo hold section is at least 15% of a length of said hull.

4. The ship according to claim 1, wherein an upper surface portion of said third cargo hold section can support a cargo such as containers.

5. The ship according to claim 1, wherein at least some of said tween decks are hoist able between at least a lowered position and a stowed position.

6. The ship according to claim 1, wherein said first and second cargo hold sections include cell guides.

7. The ship according to claim 1, wherein said passageway is provided in one and/or both sides of said rear part.

8. The ship according to claim 1, wherein said passageway is at least partially upwardly inclined towards said central part.

* * * * *

UNITED STATES PATENT AND TRADEMARK OFFICE

CERTIFICATE OF CORRECTION

PATENT NO. : 8,327,785 B2
APPLICATION NO. : 12/736058
DATED : December 11, 2012
INVENTOR(S) : Jens M. Nielsen It is certified that error appears in the above-identified patent and that said Letters Patent is hereby corrected as shown below:

Title page should read

Item (22) PCT Filed: Nov. 7, 2008

Signed and Sealed this
Twelfth Day of March, 2013

Teresa Stanek Rea
*Acting Director of the United States Patent and Trademark Office*